US008720089B1

(12) United States Patent
Lewis

(10) Patent No.: US 8,720,089 B1
(45) Date of Patent: May 13, 2014

(54) ULTRA-THIN RETRACTABLE LABEL HOLDER FOR RACK-MOUNTED ELECTRICAL CHASSIS

(75) Inventor: Jeffrey M. Lewis, Maynard, MA (US)

(73) Assignee: EMC Corporation, Hopkinton, MA (US)

( * ) Notice: Subject to any disclaimer, the term of this patent is extended or adjusted under 35 U.S.C. 154(b) by 71 days.

(21) Appl. No.: 13/596,088

(22) Filed: Aug. 28, 2012

(51) Int. Cl.
*B42F 17/34* (2006.01)

(52) U.S. Cl.
USPC ..... 40/375

(58) Field of Classification Search
USPC ..... 40/375, 652, 611.11
See application file for complete search history.

(56) References Cited

U.S. PATENT DOCUMENTS 3,664,048 A * 5/1972 Karlsson ..... 40/375
3,747,244 A * 7/1973 Koller ..... 40/375
3,991,495 A * 11/1976 Wilson ..... 40/375
7,389,599 B2 * 6/2008 Hishinuma et al. ..... 40/375
7,610,707 B1 * 11/2009 Payne ..... 40/641
8,443,534 B2 * 5/2013 Goodfellow et al. ..... 40/359
2004/0154197 A1 * 8/2004 Hishinuma et al. ..... 40/375

* cited by examiner

*Primary Examiner* — Shin Kim
(74) *Attorney, Agent, or Firm* — Krishnendu Gupta; Konrad R. Lee

(57) ABSTRACT

A label holder for a chassis having: a frame having a window therein and a flat, label holding member disposed within the window. The label holding member includes an integrally formed: frontal handle portion projecting outwardly from an outer edge of the chassis; label mounting surface portion disposed rearward of the handle; and flexible, serpentine spring portion disposed between the label mounting surface portion and a rearward end portion of the label holding member. The label holding member slides forward and rearward within the window. The spring portion has a plurality of elongated members traversing sides of the frame and interconnected at edges thereof by curved interconnecting sections, and wherein material forming the interconnecting sections is reduced progressively from a rearward portion of the spring towards a frontal portion of the spring.

10 Claims, 8 Drawing Sheets

ULTRA-THIN RETRACTABLE LABEL HOLDER FOR RACK-MOUNTED ELECTRICAL CHASSIS

TECHNICAL FIELD

This disclosure relates generally to label holders and more particularly to label holders for rack-mounted electrical chassis

BACKGROUND

As is known in the art, Rack-mounted computer products require exterior labels which can be read in the field. Because large, flat exterior surfaces on the front or rear of a rack-mounted product are rare, labels are typically required to be attached on loose, floppy tags to the exterior or tucked inside the product itself (taking up valuable product space). At the same time, these labels must be made accessible and easy to read, generally requiring a slide-out mechanism, whereby the label/label-holder has the ability to be slid-out (for reading) or pushed in/retracted (when not in use). If a label/label-holder is not retracted or controlled, it could cause operational problems for the product (interference with cabling, blocking connector ports, blocking inlet/outlet air vents, installation of sub-assemblies, etc.).

SUMMARY

In accordance with the present disclosure, a label holder for a chassis is provided having: a frame having a window therein and a flat, label holding member disposed within the window. The label holding member includes an integrally formed: frontal handle portion projecting outwardly from an outer edge of the chassis; label mounting surface portion disposed rearward of the handle; and flexible, serpentine spring portion disposed between the label mounting surface portion and a rearward end portion of the label holding member. The label holding member slides forward and rearward within the window. The spring portion has a plurality of elongated members traversing sides of the frame and interconnected at edges thereof by curved interconnecting sections, and wherein material forming the interconnecting sections is reduced progressively from a rearward portion of the spring towards a frontal portion of the spring. The label holder, with the integral retractable spring, is ultra-thin (~0.031" total thickness), thin enough to be mounted on the outside of a chassis or other type of computer product. The "spring" itself is a serpentine shape which is die-cut integrally to the material of the actual label holder itself. It is guided by a simple plastic laminate which protects the label holder and also contains in-and-out "stops" to control the label holder travel.

The details of one or more embodiments of the disclosure are set forth in the accompanying drawings and the description below. Other features, objects, and advantages of the disclosure will be apparent from the description and drawings, and from the claims.

DESCRIPTION OF DRAWINGS

Like reference symbols in the various drawings indicate like elements.

DETAILED DESCRIPTION

Figure 1A:
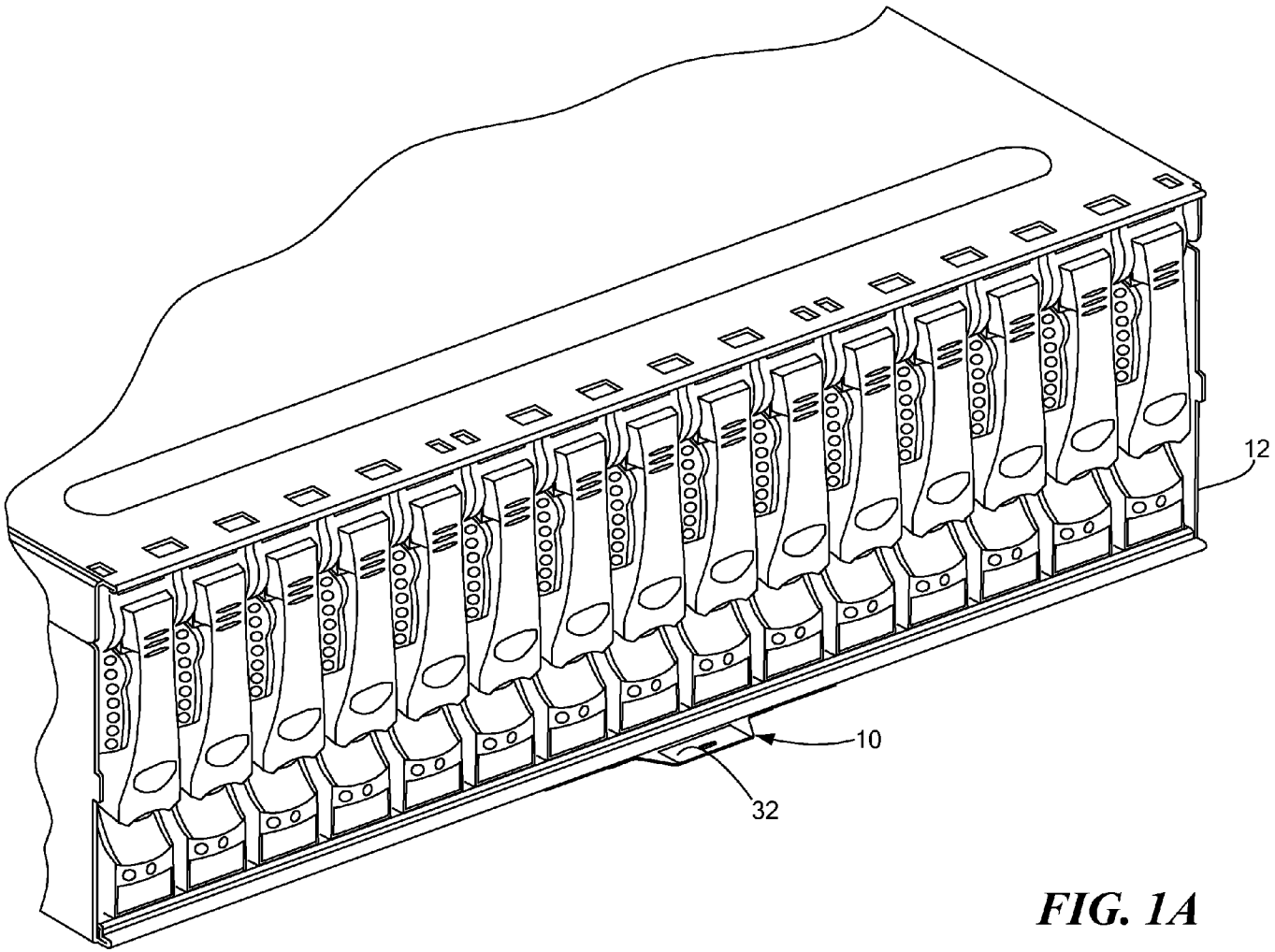
FIG. 1A is an isometric top view of a label holder according to the disclosure affixed to a bottom surface of an electrical chassis, the label holder being shown in the retracted position;\
Figure 1B:
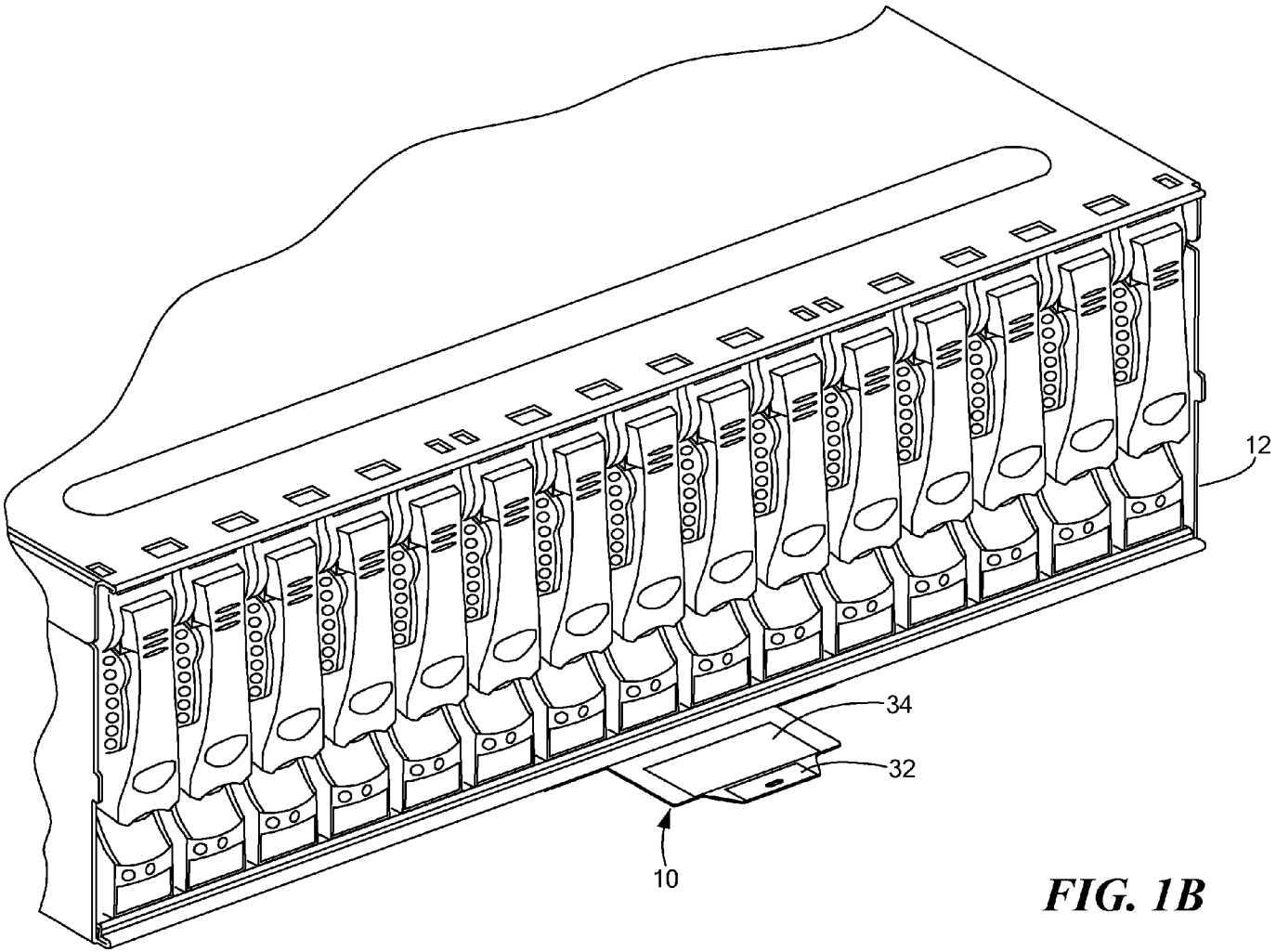
FIG. 1B is in isometric top view of the label holder of FIG. 1A affixed to the bottom surface of the electrical chassis, the label holder being shown in the extended position to enable reading of a label affixed to the label holder.
Figure 1C:
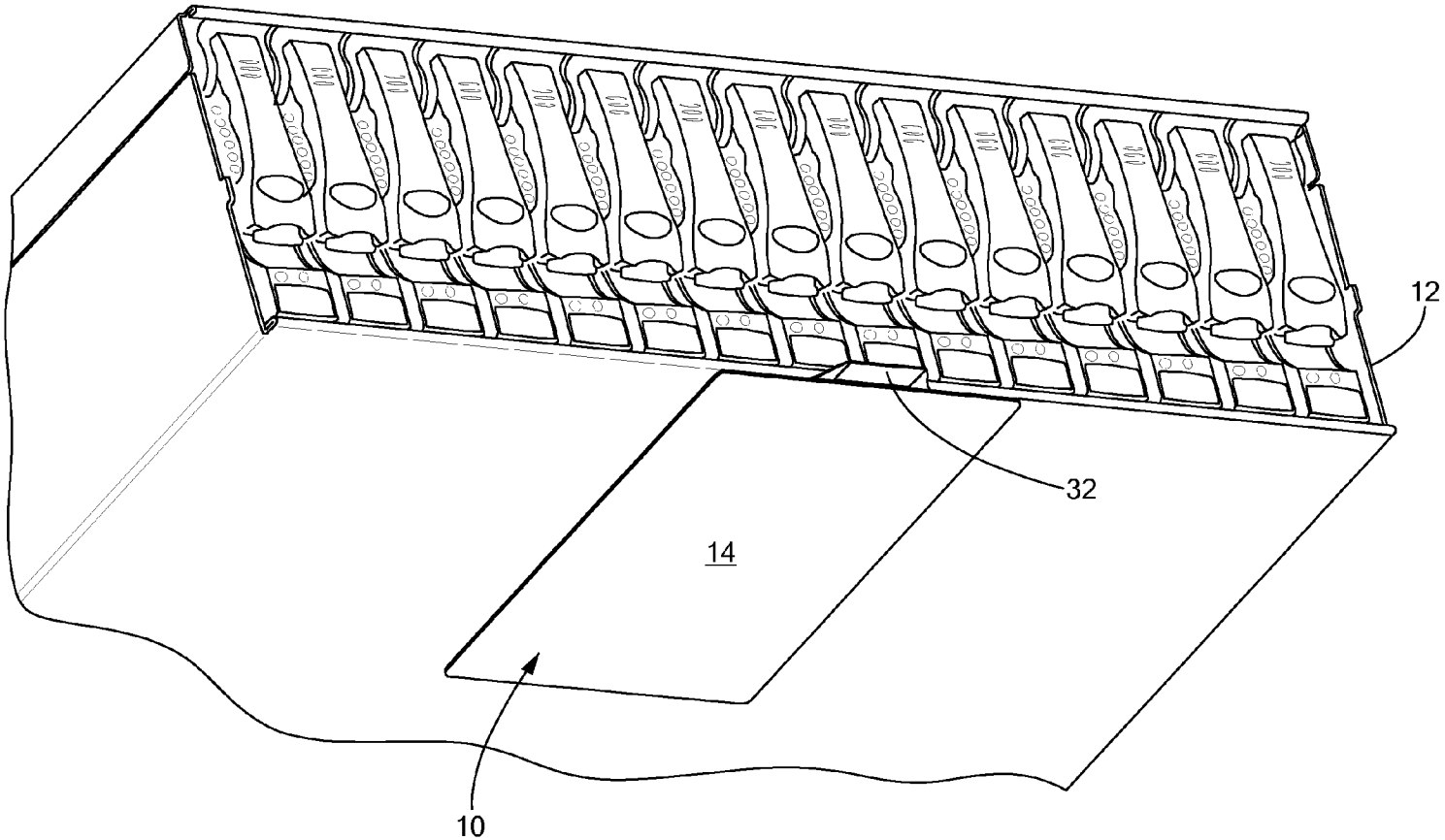
FIG. 1C is an isometric bottom view of the label holder of FIG. 1A affixed to the bottom surface of the electrical chassis, the label holder being shown in the retracted position.
Figure 2A:
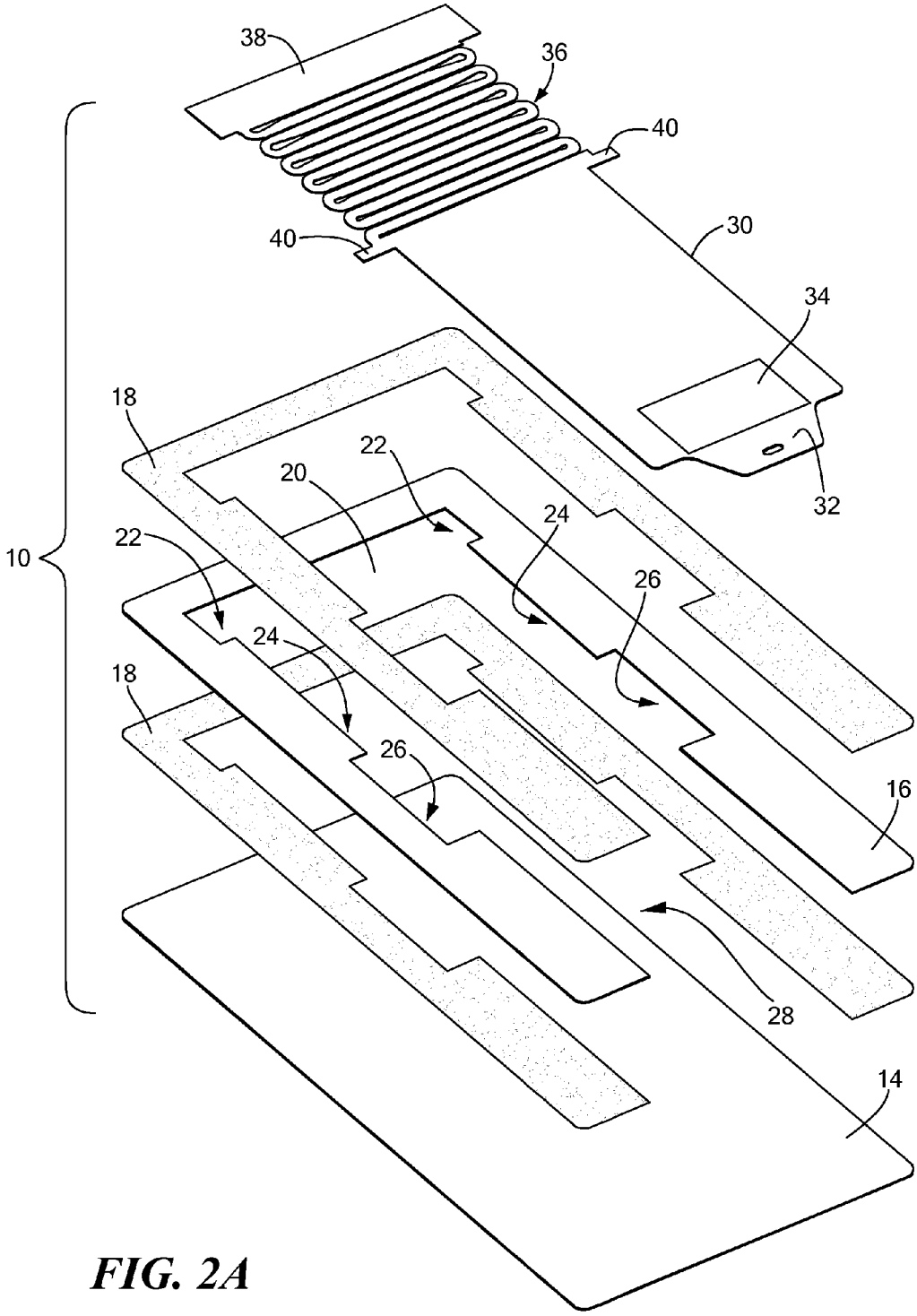
FIG. 2A is an exploded assembly view of the label holder of FIG. 1A, the label holder being shown in the retracted position.
Figure 2B:
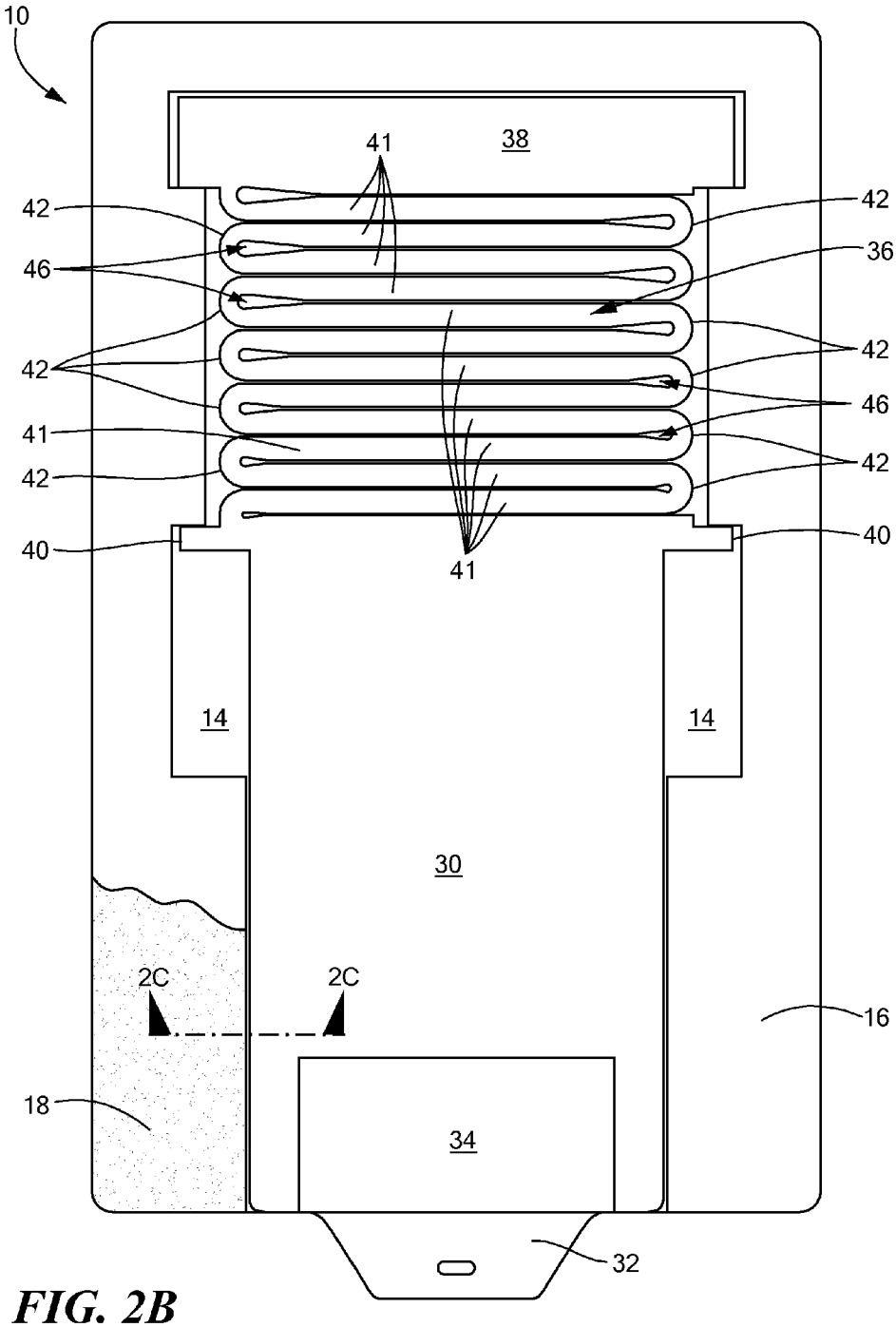
FIG. 2B is a top plan view of the label holder of FIG. 1A, the label holder being shown in the retracted position.
Figure 2C:
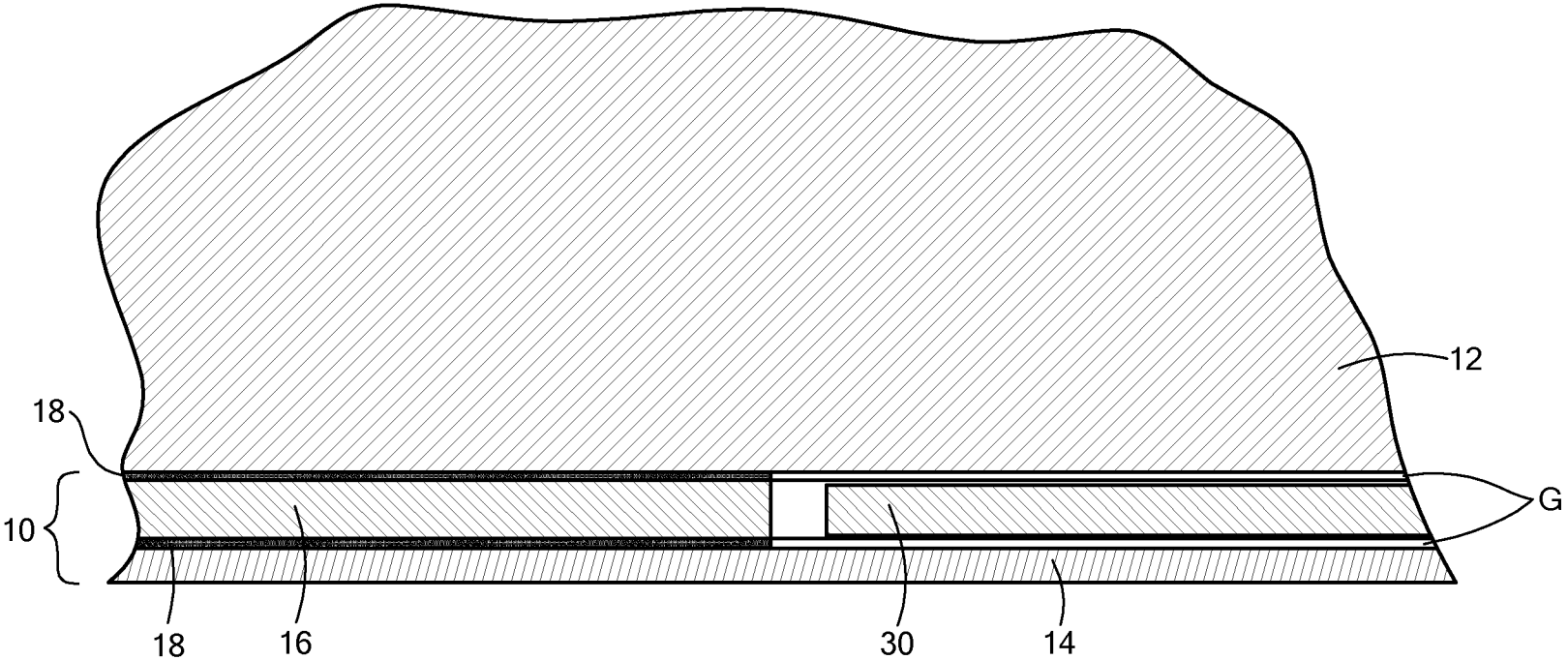
FIG. 2C is a cross sectional view of the label holder of FIG. 1A affixed to the bottom surface of the electrical chassis, the cross section of the label holder being along line 2C-2C in FIG. 2B.

Referring now to FIGS. 1A, 1B and 1C, a label holder 10 is shown attached to a bottom surface of an electrical chassis 12. The label holder 10 includes: a flat base, or back plate 14 (FIGS. 1C, 2B and 2C), here for example, a 0.010 inch thick Polycarbonate; and a frame 16, here also a flat Polycarbonate material having a thickness of 0.017 inches is applied to the upper and lower surface of the frame 16, here the adhesive film 18 has a thickness of 0.002 inches on each surface of the frame 16. The adhesive film 18 attached to the lower surface of the frame 18 secures the frame 18 to the base 14. The adhesive film 18 on the upper surface of the frame 16 secures the frame 16 to the bottom surface of the electrical chassis 12 as indicated in FIG. 2C. The shape of the adhesive film 18 is the same shape as the frame 18.

More particularly, the frame 16 has a window 20 (FIG. 2A) therein. The window 20 has: a rear end portion 22; a first portion 24 narrower than, and forward of, the rear portion 22; a pair of elongated slot portions 26 forward of the first portion 24, such slot portion 26 being wider than the first portion 24; and a frontal portion 28 forward of and narrower than the slot portion 26.

The label holder 10 (FIG. 2A) includes a flat, label holding member, 30 here a 0.010 inch thick Poly-carbonate material, disposed within the window 20 and having an integrally formed: a frontal handle portion 32 (FIGS. 1A, 1B, 1C, 2A) projecting outwardly from an outer edge of the chassis 12 (FIGS. 1A, 1B, 1C), (i.e., the handle portion 32 projects outwardly from a front or rear panel of the chassis 12); a label mounting surface portion 34 disposed rearward of the handle portion 32 and disposed within the frontal portion 28 of the window 20; a flexible, flat, serpentine retractable spring portion 36 disposed between the label mounting surface portion 34 and a rearward end portion 38 of the flat, label holding member 30 and disposed within the first portion 24 of the window 20; a rear securing member 38 disposed between a rear end portion of the spring portion 36 and a rear end of the flat, label holding member 30, the rear securing member 39 being wider than the spring portion 36 and being disposed within the rear portion 22 of the window 20; and a pair of stop travel tabs 40 disposed between a front portion of the spring portion 36 and a rear portion of the label mounting surface portion 34, the pair of stop travel tabs 40 being wider than the spring portion 36 and the label mounting surface portion 34 and being disposed within the pair of elongated slot portions 26.

Figure 3A:
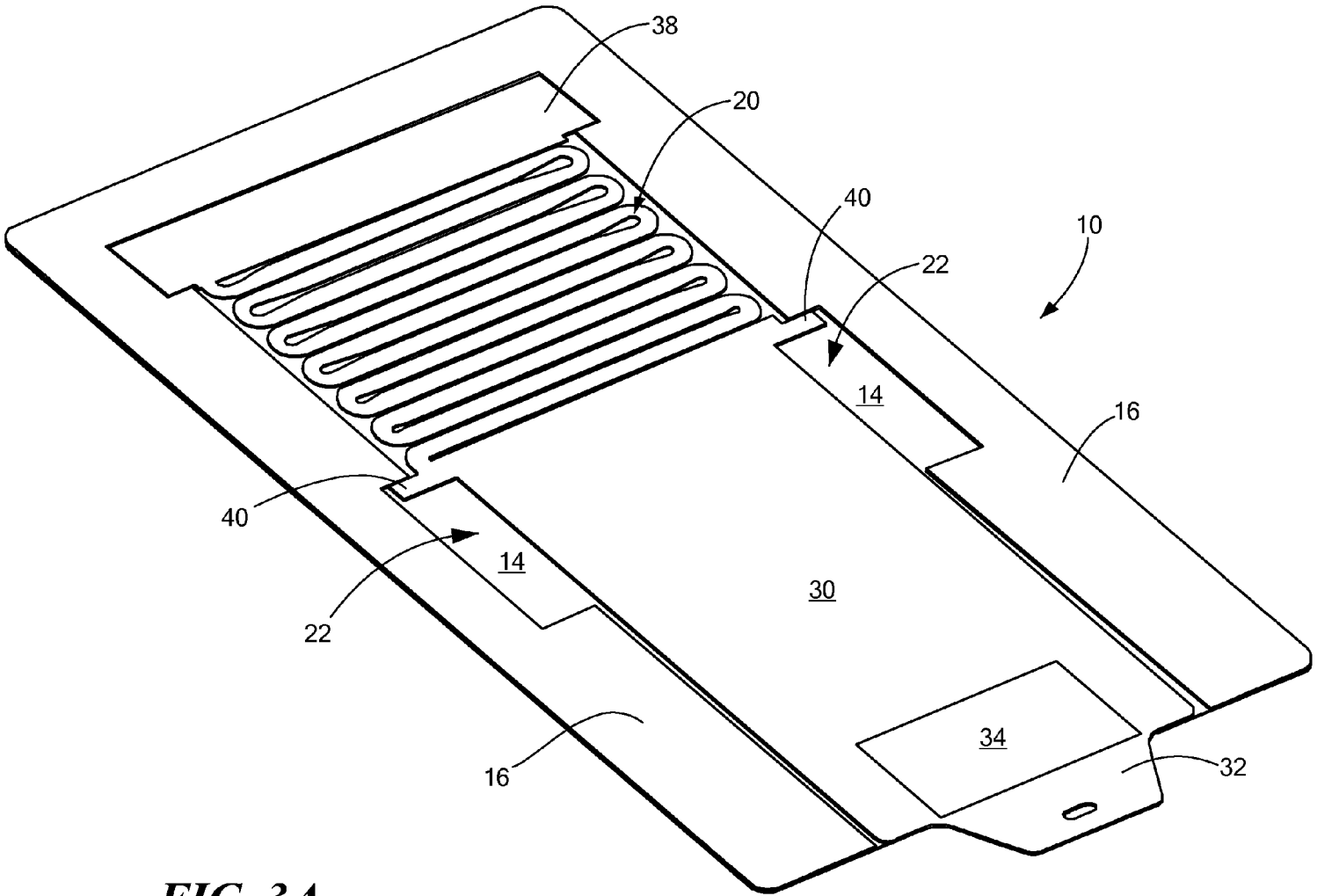
FIG. 3A is an isometric top view of the label holder of FIG. 1A, the label holder being shown in the retracted position.
Figure 3B:
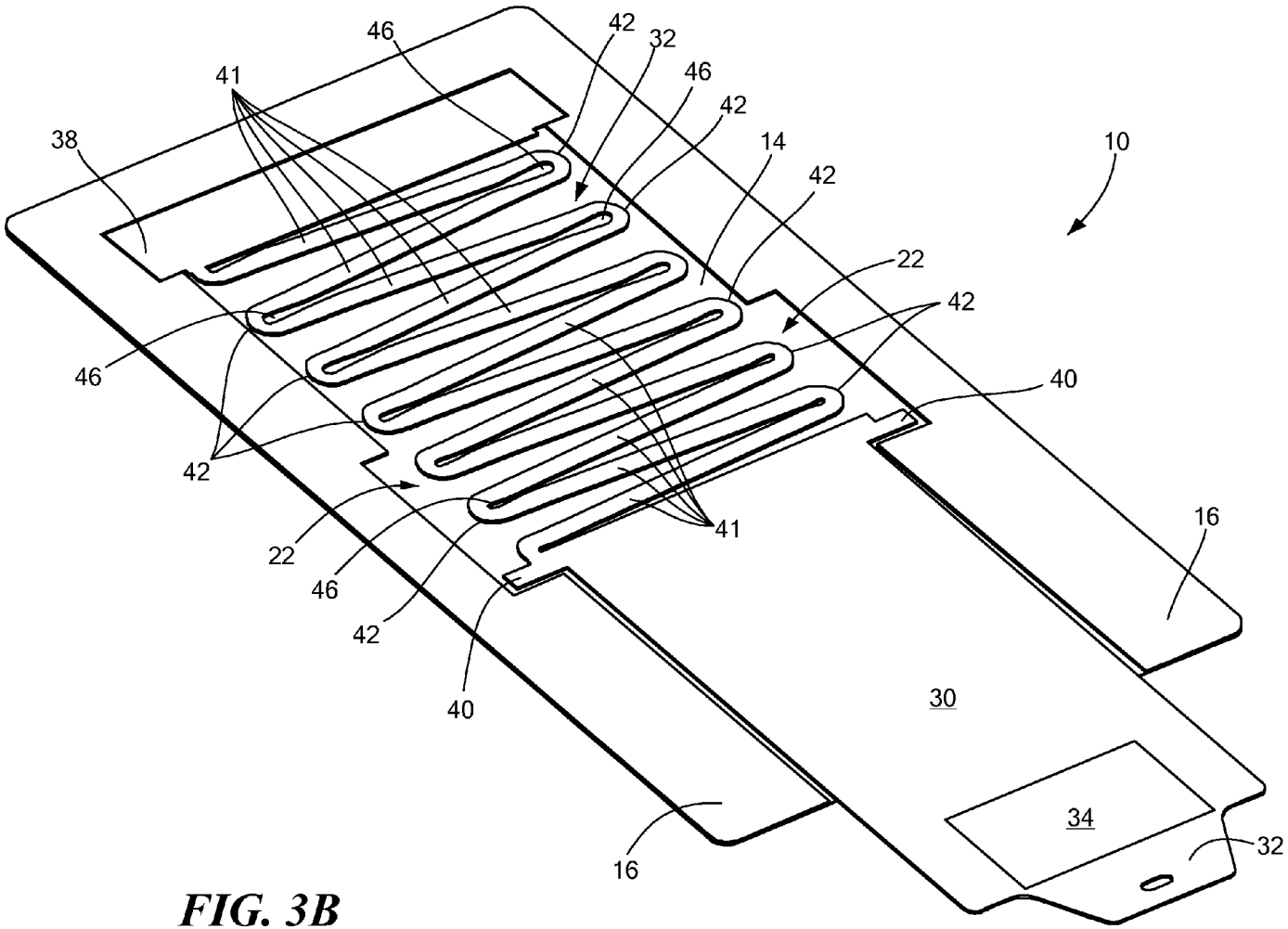
FIG. 3B is an isometric top view of the label holder of FIG. 1A, the label holder being shown in the extended position.

Referring now also to FIGS. 3A and 3B, the label holding member 30 slides forward and rearward within the window 20 (FIG. 2A) between the base 14 and a bottom of the chassis 12 (FIG. 2C) with travel of the label holding member 30 being restrained by the pair of tabs 40 engaging forward and rearward edges of the pair of stops 22 within the elongated slot portions 26. Manually forwardly extending the label holding member 30 from the position shown in FIG. 3A) by the handle 32 extends the label holding portion 34 forward of the front or rear surface of the chassis 16 stretches the spring portion 36 as shown in FIG. 3B to enable reading on a label mounted to the label holding member 34 and thereafter releasing the handle 32 causes the spring portion 32 to compress as shown in FIG. 3A and thus the label holding member 30 slidably returns (i.e., retracts) the forwardly extending the label holding member 34 under the chassis 16.

As noted above, the 0.002 inch thick adhesive film 18, shown is FIG. 2C applied to the upper and lower surface of the frame 16 provides a 0.0055 inch gap, G, between the lower surface of the frame 16 and the upper surfaced of the base 14 bottom surface and also a 0.0055 inch gap, G, between the upper surface of the frame 16 and the bottom surface of the chassis 12, as indicated in FIG. 2C. These gaps allow the label holding member 30 to slide between the chassis 12 and the base 14.

In operation, when in the retracted position (FIG. 3A), if an operator wishes to read the label, the operator grasps the handle 32 and slides the flat, label holding member 30 outwardly from under the electrical chassis 16 as shown in FIG. 1B. After the label is read the operator releases the handle 32 and the spring portion 32 compresses to retract the label holder member 30 and returns the label on portion 34 under the electrical chassis 16 as shown in FIG. 1A.

It is noted that spring portion 32 has a plurality of elongated members 41 (FIG. 2B) traversing sides of the frame 16 and interconnected at edges thereof by curved interconnecting sections 42. It is also noted that the material forming the interconnecting sections 42 is progressively reduced from those elongated members 41 in the rearward portion of the spring portion 36 towards a frontal portion of the spring. More particularly, it is noted that the ends of the elongated members 41 are attached by generally arch shaped interconnecting sections 42. It is also noted that the space 46 central to the arch of the sections 42 are wider at the rear portion of the spring 36 than those at the forward portion of the spring 32. To put it another way, the arch shaped interconnecting sections 42 at the rear end of the spring 32 are narrower in the plane of the spring 32 than the arch shaped interconnecting sections 42 at the forward portion of the spring 32. Such an arrangement ensures that when the handle 32 is pulled by the operator to extend the label holder, as shown in FIG. 3B, there is extension of the spring 32 along the entire spring 32 and not just in the forward portion of the spring 32. That is, it is noted in FIG. 3B that the elongated members 41 at the rear of the spring 32 are also extended one from the other, albeit not to the same degree as with the forward elongated members 41. This effect results from the fact that having less material in the interconnecting members 41 at the rear of the spring 32 enables extension of the rearward interconnection members 41 with less force that that required to extend the forward portion of the spring 32.

A number of embodiments of the disclosure have been described. Nevertheless, it will be understood that various modifications may be made without departing from the spirit and scope of the disclosure. For example, the materials and thickness used herein may be different that those disclosed. Accordingly, other embodiments are within the scope of the following claims.

What is claimed is:

1. A label holder for a chassis, comprising:
a frame having a window therein;
a flat, label holding member disposed within the window and having an integrally formed:
frontal handle portion projecting outwardly from an outer edge of the chassis;
label mounting surface portion disposed rearward of the handle;
flexible, serpentine spring portion disposed between the label mounting surface portion and a rearward end portion of the label holding member; and
wherein the label holding member slides forward and rearward within the window.

2. The label holder recited in claim 1 wherein the window has a travel stopping slot formed therein and wherein the label holding member has a tab disposed within the slot.

3. The label holder recited in claim 1 wherein the holder includes:
a base;
wherein the frame has one surface affixed to the base and an opposite surface affixed to a surface of the chassis; and
wherein the label holding member slides between the base and the surface of the chassis.

4. The label holder recited in claim 2 wherein the window has a travel stopping slot formed therein and wherein the label holding member has a tab disposed within the slot.

5. The label holder recited in claim 1 wherein the spring portion has a plurality of elongated members traversing sides of the frame and interconnected at edges thereof by curved interconnecting sections, and wherein material forming the interconnecting sections is reduced progressively from a rearward portion of the spring towards a frontal portion of the spring.

6. The label holder recited in claim 2 wherein the spring portion has a plurality of elongated members traversing sides of the frame and interconnected at edges thereof by curved interconnecting sections, and wherein material forming the interconnecting sections is reduced progressively from a rearward portion of the spring towards a frontal portion of the spring.

7. The label holder recited in claim 3 wherein the spring portion has a plurality of elongated members traversing sides of the frame and interconnected at edges thereof by curved interconnecting sections, and wherein material forming the interconnecting sections is reduced progressively from a rearward portion of the spring towards a frontal portion of the spring.

8. The label holder recited in claim 4 wherein the spring portion has a plurality of elongated members traversing sides of the frame and interconnected at edges thereof by curved interconnecting sections, and wherein material forming the interconnecting sections is reduced progressively from a rearward portion of the spring towards a frontal portion of the spring.

9. A label holder for a chassis, comprising:
a base;
a frame having:
a window therein; and
an adhesive on upper and lower outer surfaces of the frame; the adhesion on the lower outer surface affixing the frame to the base, the adhesive on the upper surface affixing the frame to an upper or lower surface of the chassis;

the window having:

a rear end portion;

a first portion narrower than the rear portion forward of the rear portion;

an elongated slot portion forward of the first portion, such slot portion being wider than the first portion; and a frontal portion forward of the slot portion, the forward portion being narrower than the slot portion;

a flat, label holding member disposed within the window and having an integrally formed:

a frontal handle portion projecting outwardly from an outer edge of the chassis;

a label mounting surface portion disposed rearward of the handle portion and disposed within the frontal portion of the window, the label mounting surface portion being deposed under the chassis when the label holder is in a retracted position;

a flat, flexible, serpentine retractable spring portion disposed between the label mounting surface portion and a rearward end portion of the flat, label holding member and disposed within the first portion of the window;

a rear securing member disposed between a rear end portion of the spring portion and a rear end of the flat, label holding member, the rear securing member being wider than the spring and disposed with the rear portion of the window;

a stop travel tab disposed between a front portion of the spring portion and a rear portion of the label mounting surface portion, the stop travel tab being wider than the spring portion and the label mounting surface portion and disposed within the elongated slot portion;

wherein the label holding member slides forward and rearward within the window between the base and a bottom of the chassis with travel of the label holding member being restrained by the tab engaging forward and rearward edges of the stop travel tab within the elongated slot portion; and wherein forwardly extending the label holding member by the handle to extend the label holding portion forward of the front or rear surface of the chassis stretches the spring to enable reading on a label mounted to the label holding member and thereafter releasing the handle causes the spring to compress and slidably return the forwardly extended label holding member to the retracted position.

10. The label holder recited in claim 9 wherein the spring portion has a plurality of elongated members traversing sides of the frame and interconnected at edges thereof by curved interconnecting sections, and wherein material forming the interconnecting sections is reduced progressively from a rearward portion of the spring towards a frontal portion of the spring.

* * * * *